United States Patent [19]

Kusumoto et al.

[11] Patent Number: 5,023,662

[45] Date of Patent: Jun. 11, 1991

[54] IMAGE FORMATION WITH MANUAL AND AUTOMATIC EXPOSURE ADJUSTMENT

[75] Inventors: Keiji Kusumoto; Kenzo Nagata, both of Osaka, Japan

[73] Assignee: Minolta Camera Co., Ltd., Osaka, Japan

[21] Appl. No.: 404,772

[22] Filed: Sep. 8, 1989

[30] Foreign Application Priority Data

Sep. 9, 1988 [JP] Japan ..... 63-227197
Sep. 9, 1988 [JP] Japan ..... 63-227198

[51] Int. Cl.[5] ..... G03G 15/04; G03G 15/01

[52] U.S. Cl. ..... 355/228; 355/313; 355/326; 355/69

[58] Field of Search ..... 355/208, 214, 228, 246, 355/313-314, 326, 327, 67, 68, 69

[56] References Cited

U.S. PATENT DOCUMENTS 4,275,958 6/1981 Tachika et al. ..... 355/313
4,542,985 9/1985 Hanna ..... 355/69
4,568,173 2/1986 Abuyama ..... 355/208 X
4,655,579 4/1987 Adachi ..... 355/218
4,711,569 12/1987 Nishimori et al. ..... 355/69
4,763,163 8/1988 Hamano et al. ..... 355/314

FOREIGN PATENT DOCUMENTS 59-86036 5/1984 Japan ..... 355/214

*Primary Examiner*—Joan H. Pendegrass
*Attorney, Agent, or Firm*—Willian Brinks Olds Hofer Gilson & Lione

[57] ABSTRACT

A copying apparatus reproducing images of originals in either of a single color and a plurality of colors, and being capable of adjusting the reproduction density of originals manually or automatically. This copying apparatus comprises a selector which selects one mode from a first reproduction mode wherein images of originals are reproduced in a single color and a second reproduction mode wherein images of originals are reproduction in a plurality of colors. Further, the copying apparatus according to the present invention can select an automatic adjusting mode wherein the reproduction density is automatically adjusted in response to the selection of said first reproduction mode, and a manual adjusting mode wherein the reproduction density is manually adjusted in response to the selection of said second reproduction mode.

21 Claims, 8 Drawing Sheets

1
#27
FMULTC = 1 ?
N
Y
#28
color selecting key ON?
N
Y
#29
turn on monocolor mode indicator 70a
#30
turn off multicolor mode indicator 71a
#31
turn on automatic exposure indicator 60
#32
FAES ← Ø
#33
FAE ← 1
#34
turn off exposure level indicator 58
#35
FMULTC ← Ø
2
#36
key 57 ON ?
N
Y
#37
FAES = 1 ?
Y
N
#38
turn on automatic exposure indicator 60
#39
turn off exposure level indicator 58
#40
FAE ← 1
3

3

#41
key 56a ON ?
N
Y
#42
turn off automatic exposure indicator 60
#43
key 56b ON ?
Y
N
#44
FAE = 1 ?
Y
N
#45
exposure level indicator MAX?
Y
N
#46
increase exposure amount
#47
key 56b ON ?
N
Y
#48
turn off automatic exposure indicator 60
#49
FAE=1 ?
Y
N
#52
FAE ← Ø
#50
exposure level indicator MIN?
Y
#53
turn on exposure level indicator 58e
#51
decrease exposure amount
return

IMAGE FORMATION WITH MANUAL AND AUTOMATIC EXPOSURE ADJUSTMENT

BACKGROUND OF THE INVENTION

1. Field of the Invention

The present invention relates to image forming apparatus, and more particularly to an image forming apparatus having an automatic exposure mode and a manual exposure mode.

2. Description of the Related Arts

Presently, copying apparatus for reproducing images of orignals on copy paper are proposed and available which have an automatic exposure mode in which the amount of exposure is automatically determined on detecting the density of the original, and a manual exposure mode in which the operator determines the amount of exposure. Such copying apparatus are adapted to be set in the automatic exposure mode usually in preference. More specifically, the automatic exposure mode is selected automatically immediately after the power supply has been turned on or when the apparatus is not manipulated in any way within a predetermined period of time after operation.

In recent years, multicolor copying apparatus have also been developed which have a monocolor mode wherein images of originals are reproduced in a desired color, and a multicolor mode wherein images of documents are reproduced in the original color. Attempts are also made to provide such multicolor copying apparatus which are settable in the automatic exposure mode and the manual exposure mode described above and which are thereby made more convenient to use and given improved image reproducibility.

However, the monocolor mode and the multicolor mode are different in the requirement to be fulfilled as to the images to be formed. In the monocolor mode, the copy image must be in contrast with the background regardless of the color of the background, whereas in the multicolor mode, the original needs to be reproduced with fidelity. Accordingly, automatic exposure is useful in the monocolor mode, but if automatic exposure is resorted to in the multicolor mode, the exposure voltage is likely to vary depending on the color or density of the original to result in objections. For example, grayish areas will not be reproduced, or areas of a particular color will not always be reproduced with the same color density by being influenced by the surrounding pattern. Consequently, if multicolor copying apparatus are made settable in the automatic exposure mode always in preference, there arises the problem that the multicolor mode is unable to produce proper copy images unless the automatic exposure mode is changed to the manual exposure mode.

SUMMARY OF THE INVENTION

The main object of the present invention is to provide a multimode copying apparatus having a plurality of modes and adapted to reproduce originals with fidelity in any of these modes.

Another object of the invention is to provide a multimode copying apparatus which is easy to use.

Still another object of the invention is to provide a multicolor copying apparatus having a multi-color mode and a monocolor mode and adapted to reproduce originals with fidelity in either of these modes.

These objects of the present invention are fulfilled by providing a multimode copying apparatus having at least two modes of a first mode and a second mode, and further having a manual mode to be set when the first mode is set and an automatic mode to be set when the second mode is set, the manual mode being automatically selectable when the first mode is selected.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

FIG. 1 is a diagram showing the overall construction of the copying apparatus;

FIG. 2 is a plan view showing the operation panel of the copying machine of FIG. 1;

FIG. 3 is a fragmentary circuit diagram of the control system of the copying machine shown in FIG. 1;

FIG. 4 is a flow chart showing the operation of the copying apparatus as it is set in a multicolor mode;

FIG. 5 is a main flow chart showing a process for controlling the copying apparatus; and FIGS. 6 (*a*), (*b*) and (*c*) are flow charts showing an exposure mode indication processing subroutine of the copying apparatus.

DESCRIPTION OF THE PREFERRED EMBODIMENTS

Figure 1:
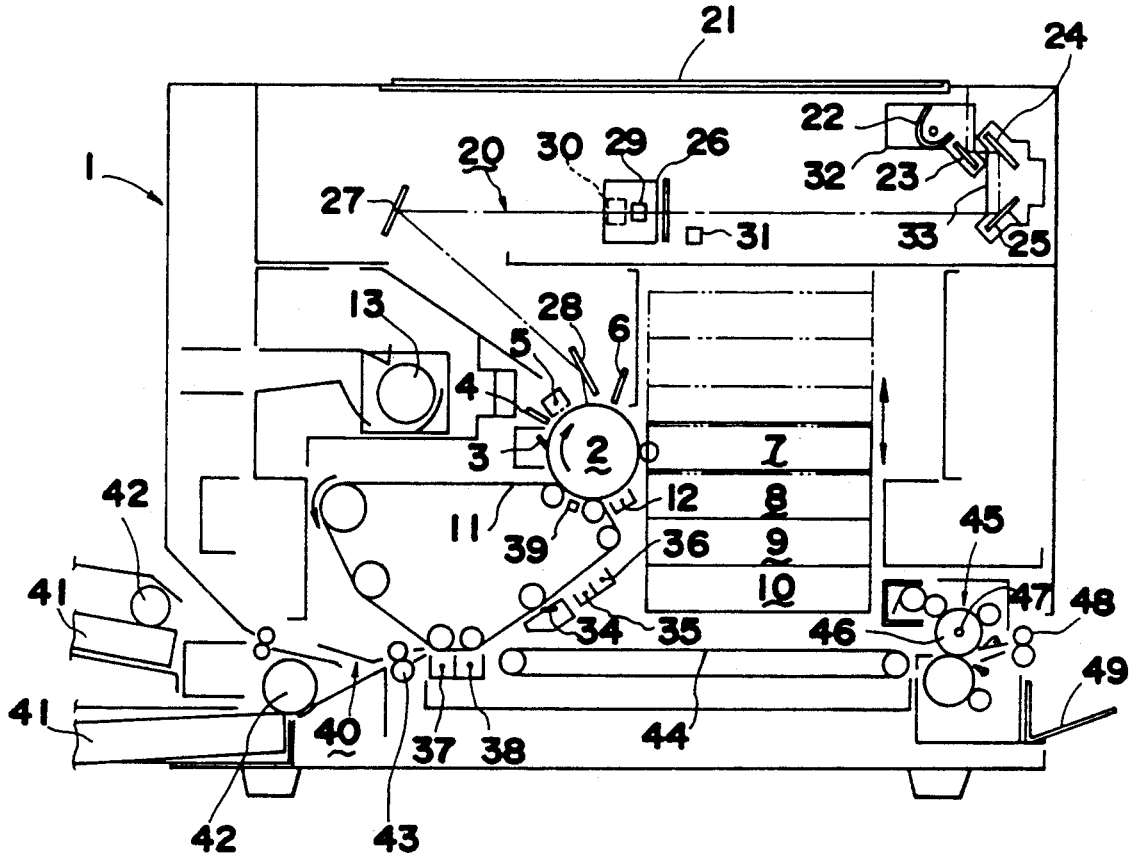
FIGS. 1 to 6 show a multicolor copying apparatus embodying the invention.
Figure 2:
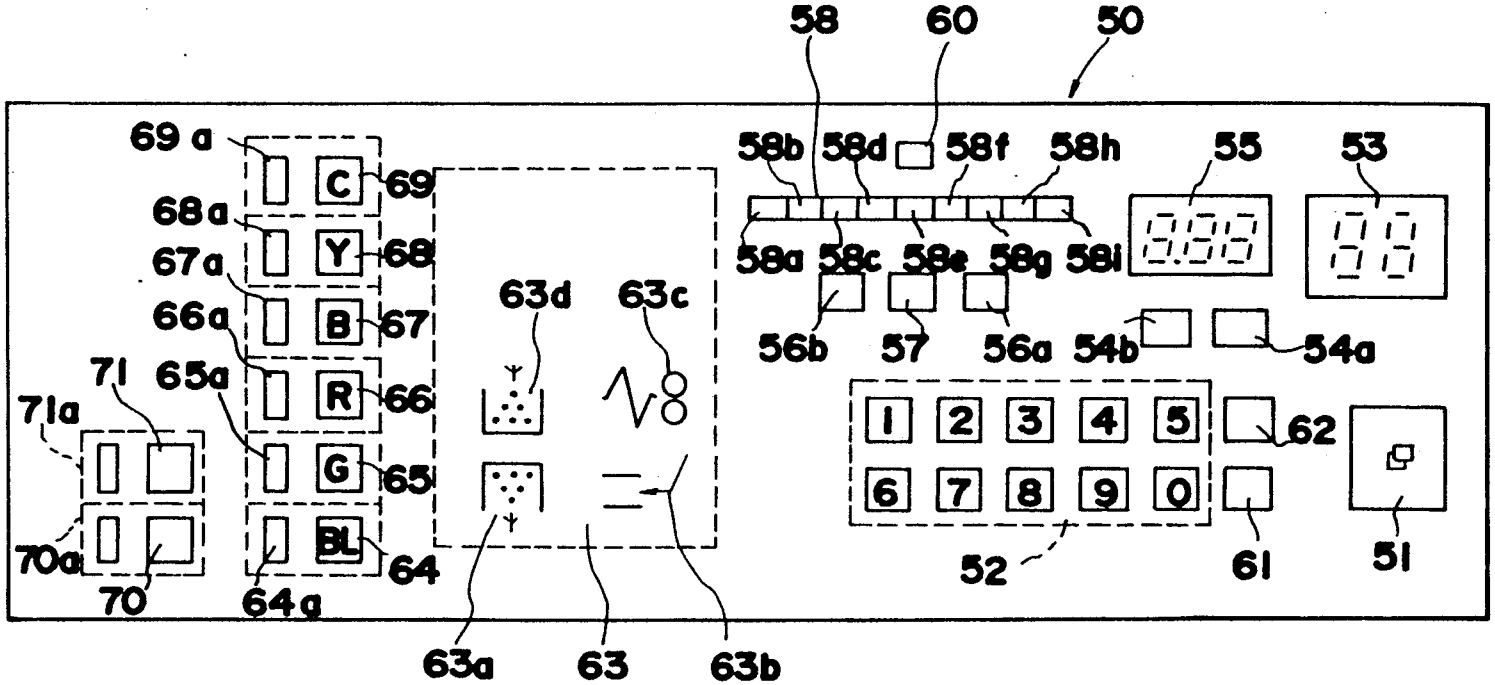

An embodiment of the present invention will be described below with reference to FIGS. 1 to 6.

The overall construction of the copying apparatus will be described with reference to FIG. 1. A photosensitive drum 2 drivingly rotatable clockwise is disposed inside the body 1 of the apparatus approximately centrally thereof. Arranged around the drum 2 in the direction of rotation are a cleaner unit 3, main eraser lamp 4, sensitizing charger 5, LED array 6, developing units 7 to 10, eraser charger 12 and transfer belt (intermediate transfer medium) 11.

The photosensitive drum 2 has a photosensitive layer formed over the surface thereof, is uniformly charged over the surface when passing by the main eraser lamp 4 and the sensitizing charger 5 and is exposed to the light from an optical system 20.

The optical system 20 is disposed under a document support glass plate 21 provided on the top of the body 1 and is movable to scan the image of an original M. The system 20 comprises a light source 22, movable mirrors 23 to 25, a main lens unit 26, and mirrors 27, 28. The main lens unit 26 has a color CCD 30 and a CCD lens 29 for concentrating an image of the original M on the color CCD 30. Indicated at 31 is a sensor for detecting the light reflected from the original in an automatic exposure mode.

A scanner 32 carrying the light source 22 and the movable mirror 23 thereon moves at a velocity of V/m wherein V is the peripheral velocity of the drum 2, and m is a copying magnification, while a slider 33 provided with the movable mirrors 24, 25 travels at a velocity of V/2m. The scanner 32 and the slider 33 are driven by an unillustrated scan motor.

The first to fourth developing units 7 to 10 can be of suitable type. With the present embodiment, yellow toner is used for the first developing unit 7, magenta toner for the second developing unit 8, cyan toner for the third developing unit 9 and black toner for the fourth developing unit 10. These four developing units 7 to 10 are arranged vertically and are movable upward and downward by an elevator. One developing unit is usable always at a time, and one of the units 7 to 10 is selected by driving the elevator.

Toner images formed on the photosensitive drum 2 are transferred onto the transfer belt 11. Arranged around the transfer belt 11 are a belt cleaner 34, charger 35 for removing charges from the transfer belt, charger 36 for charging the belt, transfer charger 37 for transferring the toner image to copy paper and charger 38 for separating the paper from the belt. Indicated at 39 is a sensor for detecting a mark on the transfer belt 11 to operate the belt with proper timing for multitransfer operation. The belt cleaner 34 is selectively movable into or out of pressing contact with the transfer belt 11. The belt 11 can be driven counterclockwise.

Indicated at 40 is a paper transport system. The copy paper accommodated in one of paper cassettes 41 is fed into the body 1 one sheet after another by the operation of a feed roller 42. The paper fed is forwarded by a register roller 43 as timed with the image on the transfer belt 11. The transfer charger 37 transfers the toner image from the belt 11 onto the copy paper, which is then separated from the belt 11 by the separating charger 38 and transported to a fixing unit 45 by a conveyor belt 44. The toner on the paper is fixed to the paper by upper and lower fixing rollers upon being melted by a heater lamp 47 provided inside the upper roller 46. The paper is thereafter delivered from the body 1 onto a paper tray 49 outside the body by a discharge roller 48.

Indicated at 13 is a main motor serving as the main drive source of the apparatus for driving the photosensitive drum 2, transfer belt 11, feed rollers 42, register roller 43, conveyor belt 44, fixing unit 45, discharge roller 48, etc.

The LED array 6 has a multiplicity of light-emitting portions opposed to the drum 2, arranged perpendicular to the plane of FIG. 1, for example, at a pitch of 1.2 mm, and on-off controllable individually independently of one another.

A control panel 50 provided on the top front portion of the body 1 will be described next. Indicated at 51 is a print switch for starting a copying operation, at 52 an arrangement of ten number entry keys for setting the number of copies to be made, and at 53 a two-digit indicator comprising 7-segment LEDs for showing the copy number set. A magnification up key **54*a* and a magnification down key 54*b* are used for setting copying magnifications. Indicated at 55 is a three-digit indicator comprising 7-segment LEDs for showing the magnification setting. An exposure level up key 56*a* and an exposure level down key 56*b* comprise manual operation means and are used for setting the desired exposure level in a manual exposure mode. An exposure level indicator 58 comprising nine LEDs shows the exposure level, which is shiftable to a higher level by the up key 56*a* or to a lower level by the down key 56*b*. Indicated at 57 is an automatic exposure mode setting key, at 60 an automatic exposure mode indicator LED for showing that the automatic exposure mode has been selected, at 61 a clear/stop key, and at 62** an interrupt key.

An indication area 63 for showing the state of the apparatus includes an indicator **63*a* for showing overcapacity of the toner to be discarded, an indicator 63*b* for indicating that the interrupt key 63 is on, a paper jam indicator 63*c* and a toner absence indicator 63*d***.

The operation panel 50 further has color selecting keys 64 to 69 for use in a monocolor mode, color indicator LEDs **64*a* to 69*a* for indicating the color selected, mode selecting keys 70, 71 for a change-over between the monocolor mode and a multicolor mode, and selected mode indicator LEDs 70*a*, 71*a***.

Figure 3:
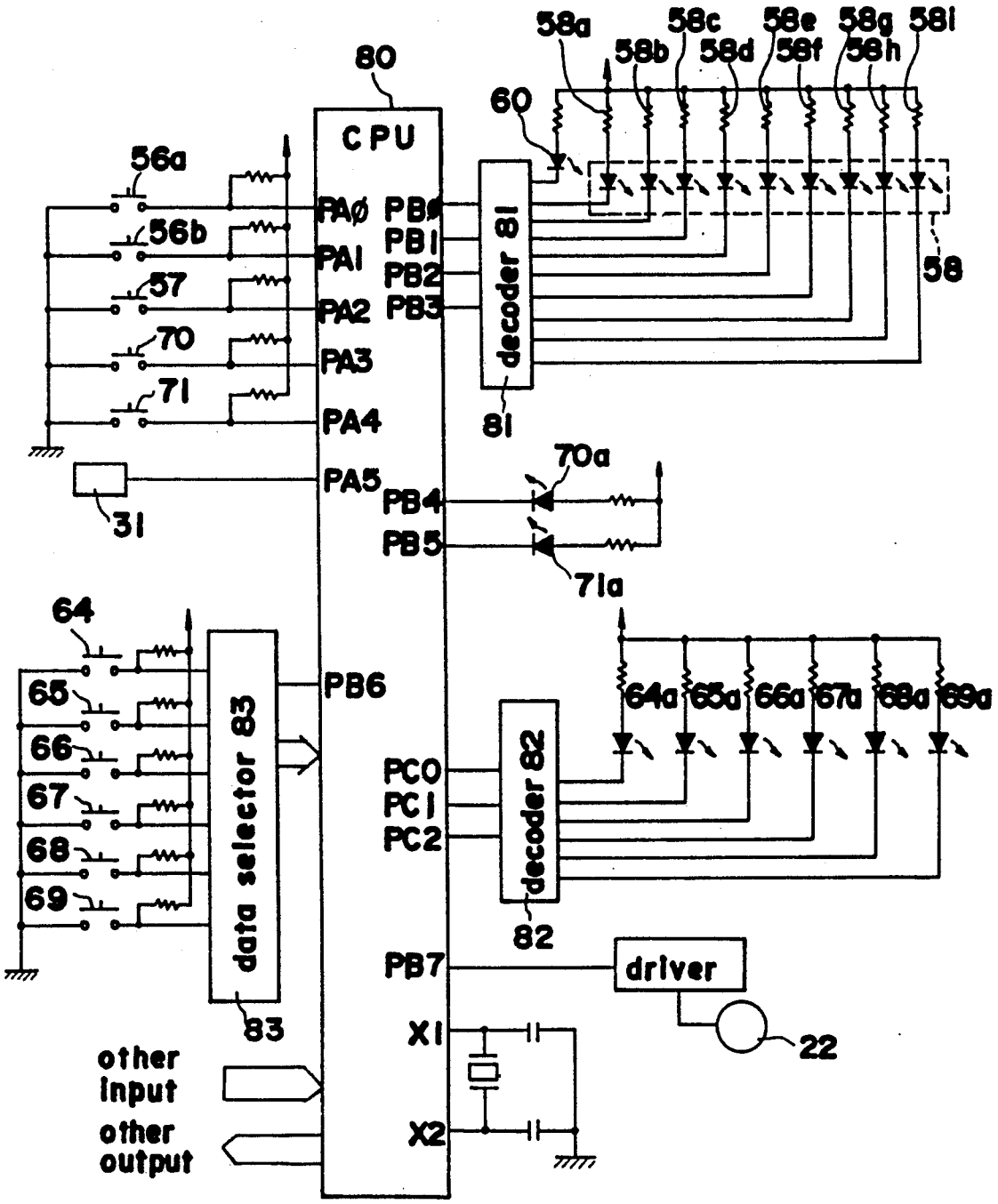

Next, the circuit construction of control system of the present apparatus will be described with reference to FIG. 3 generally in respect of a CPU 80 (one-chip microcomputer) and components connected thereto. FIG. 3 shows only the portion concerned with exposure mode indication and characterstic of the invention. The CPU 80 operates for the control of image formation, indication, key processing, etc. The CPU 80 has input ports PA0 to PA5 connected to the exposure level up key **56*a*, exposure level down key 56*b*, automatic exposure mode setting key 57, monocolor mode selecting key 70, multicolor mode selecting key 71 and reflected light sensor 31, respectively. The CPU 80 has output ports PB0 to PB3 for delivering a four-bit output to a decoder 81 for the selective on-off control of LEDs of the exposure level indicator 58 and the automatic exposure mode indicator LED 60**.

Ports PB4 and PB5 are also output ports, which are used for on-off controlling the monocolor mode indicator LED **70*a* and the multicolor mode indicator LED 71*a*. Output ports PC0 to PC2 feed a three-bit output to a decoder 82 for selectively on-off controlling the color indicator LEDs 64*a* to 69*a*. An output port PB6 controls a data selector 83, causing the selector to selectively feed to the CPU 80 data representing the state of the color selecting keys 64 to 69. An output port PB7 is connected to a driver for driving the light source 22 and produces a signal for on-off controlling the light source 22** to give a controlled amount of exposure.

"Other input" shown includes those from the number entry key arrangement 52 on the operation panel 50 and from sensors and the like participating in sequential control. "Other output" includes those for use in driving motors, solenoids etc. relating to the indication on the operation panel and sequential control.

Figure 4:
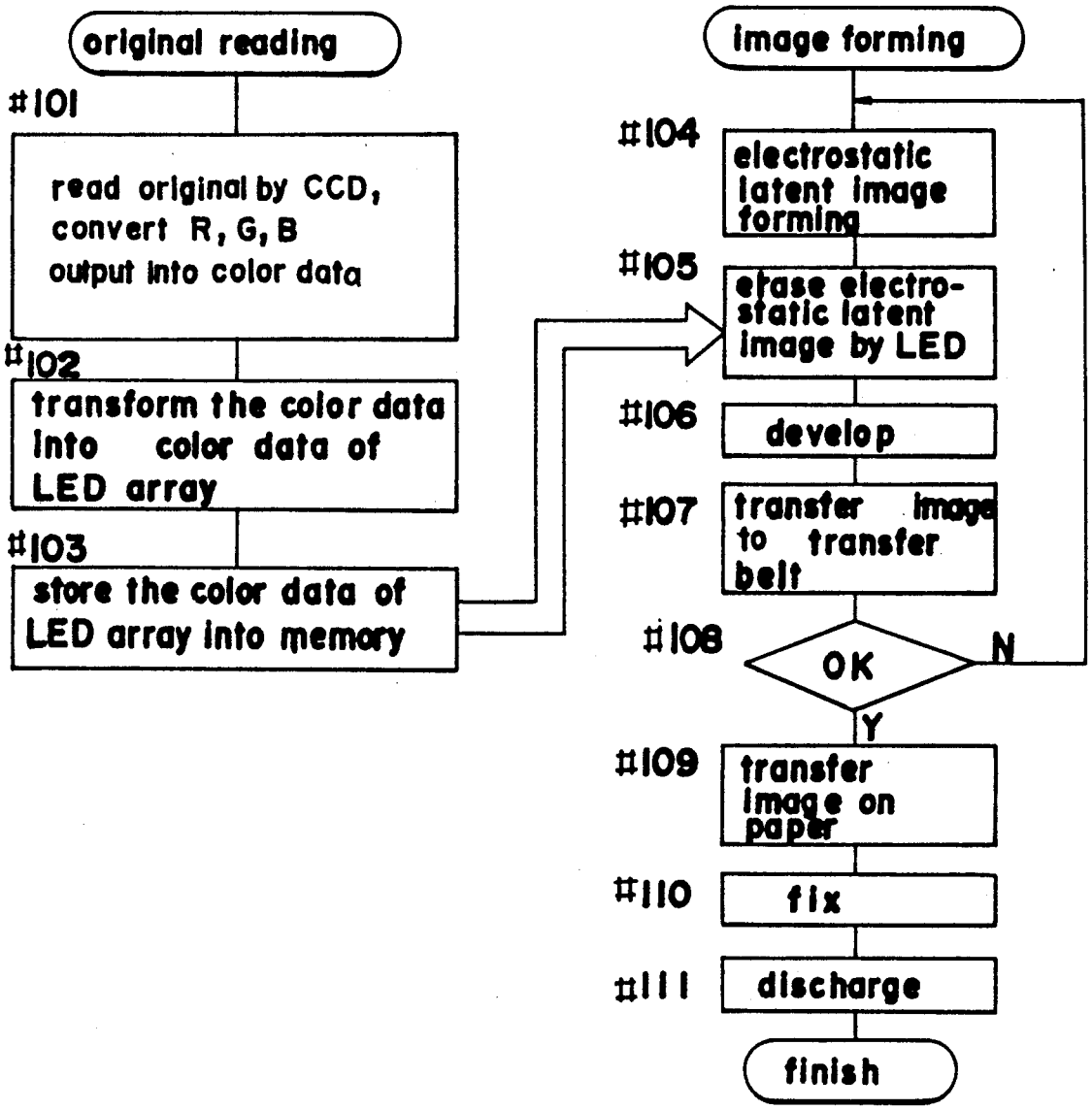

Next, the copying operation in the multicolor mode will be described briefly with reference to FIG. 4. First, the image of an original is read through steps #101 to #103. With the first scanning movement, the color CCD 30 produces R, G, B data, which is converted to color data, for example, as to seven colors in step #101 In step #102, the color data is converted to color data for driving the LED array 6. The resulting data is stored in the memory in step #103. Steps #101 to #103 are performed for the original image covered by one scanning movement, continuously with the scanning movement by a hard processing circuit, whereby the color data for the image is stored in the memory.

Next, an image forming operation follows. This operation is performed in steps #104 through #111. An electrostatic latent image corresponding to the original is formed in step #104 by scanning the original with the light from the light source 22 and projecting the reflected light on the photosensitive drum 2 via the movable mirrors 23 to 35, the main lens unit 26 and the mirrors 27, 28. In step #105, the LED array 6 erases the unecessary portion of the latent image other than the portion thereof to be currently developed in the contemplated color, with reference to the data obtained by the original reading operation and stored in the memory. The latent image is then converted to a visible toner image in step #106 by the currently selected one of the developing units 7 to 10. The toner image is transferred onto the transfer belt 11 in step #107. These steps #104 to #107 are executed continuously with the scanning movement.

On completion of the image forming operation comprising the foregoing sequence of steps performed with one scanning movement, step #108 inquires whether the image forming process of steps #104 through #107 is to be terminated. If the answer is negative, the sequence returns to step #104. Usually, the sequence proceeds to step #109 after the completion of image forming process by the first developing unit 7 (yellow toner), like process by the second developing unit 8 (magenta toner), like process by the third developing unit 9 (cyan toner) and like process by the fourth developing unit 10 (black toner). The toner image formed on the transfer belt 11 by the multi-transfer operation is transferred to copy paper in step #109, which is followed by step #110 to fix the toner image to the paper and then by step #111 to discharge the copy from the body 1. In this way, the copying operation in the multicolor mode is completed.

In the case of copying operation in the monocolor mode, the original reading operation is not performed, and the latent image is developed in a color selected on the operation panel 50. The monocolor mode is the same as the multicolor mode in that the toner image is transferred to the transfer belt 11 first and thereafter transferred to copy paper. In the case where the selected color is obtained by using a plurality of toners of different colors in combination, the image forming process is repeated the plurality of times, and the toner image formed on the transfer belt 11 by the multi-transfer operation is transferred onto copy paper. It is of course possible to prepare a composite color image in the monocolor mode by using a plurality of originals and a plurality of developing units with different colors.

Next, a description will be given of the overall control operation to be conducted by the CPU 80 and exposure mode indication processing characteristic of the present invention.

Figure 5:
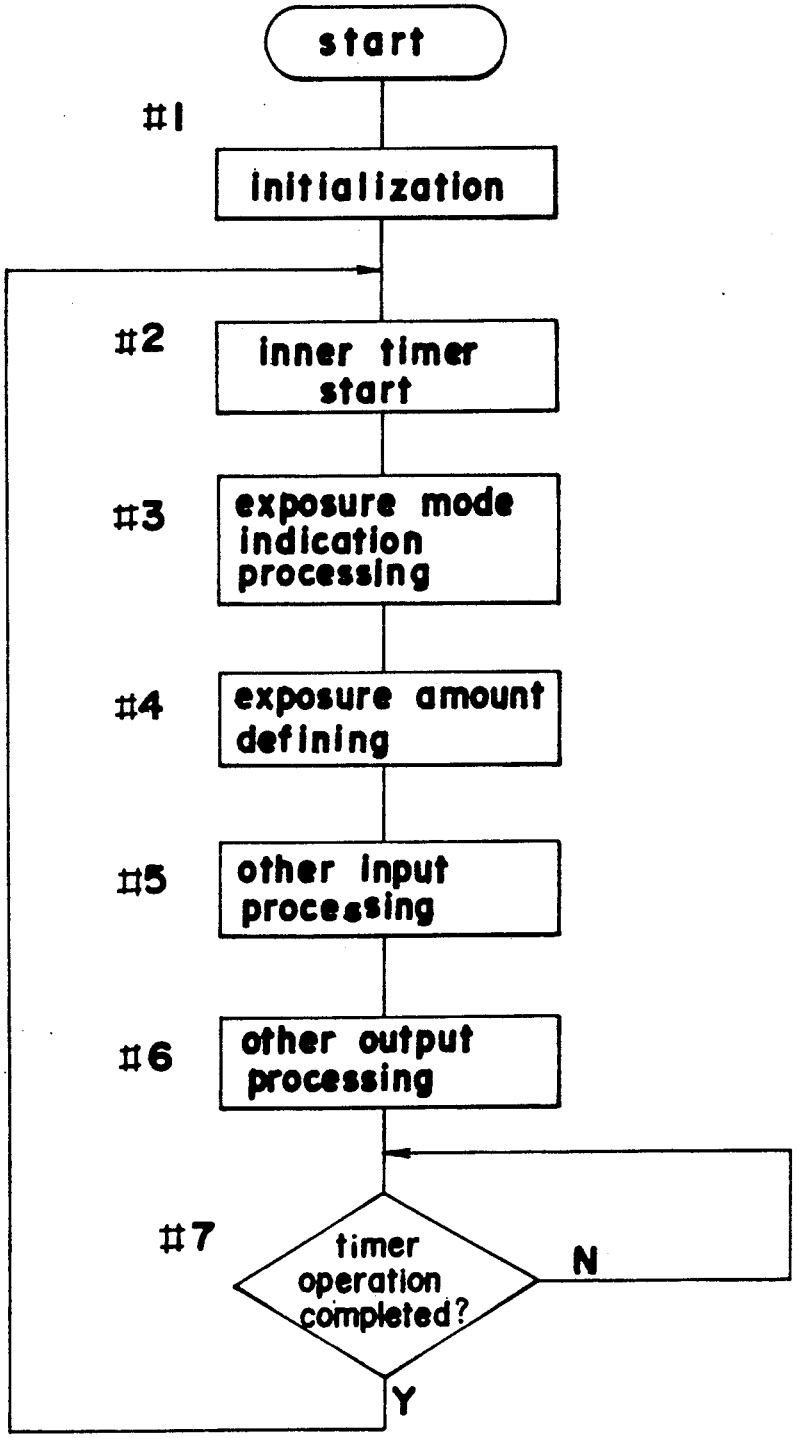

FIG. 5 is a main flow chart showing the control operation to be executed by the CPU 80. When the power supply for the apparatus is turned on, the registers, timers, etc. are initialized in step #1. An inner timer is started in step #2 for determining the length of the main routine. The exposure mode indication processing subroutine is executed in step #3. This subroutine effects processing for changes in the indications on the exposure level indicator 58 and the automatic exposure mode indicator 60 in response to the manipulation of the monocolor mode selecting key 70, multicolor mode selecting key 71, developing color selecting key, automatic exposure mode setting key 57, exposure level up key 56*a*, exposure level down key 56*b*, etc. The subroutine will be described in greater detail later with reference to FIGS. 6 (*a*) to (*c*).

In the subsequent step #4, the amount of exposure to be given by the light source 22 is determined in accordance with the indication given by the exposure mode indication processing step #3. Stated more specifically, when the automatic exposure mode indicator 60 is on, the amount of exposure by the light source 22 is adjusted to a suitable value based on the density of original detected by the reflected light sensor 31. Accordingly, if the amount of light received by the sensor 31 is small, the amount of exposure to be given by the light source 22 is set to a high value, whereas if the amount of light received by the sensor 31 is great, the exposure amount is set to a low value. When the automatic exposure mode indicator 60 is off, on the other hand, the light source 22 is set to a predetermined amount of exposure corresponding to the lighted one of the nine LEDs constituting the exposure level indicator 58.

Other input and output processing concerned with the image forming operation is executed in steps #5 and #6. On completion of the operation of the inner timer in step #7, the sequence returns to step #2. While the power supply is on, steps #2 through #7 are repeated.

Figure 6A:
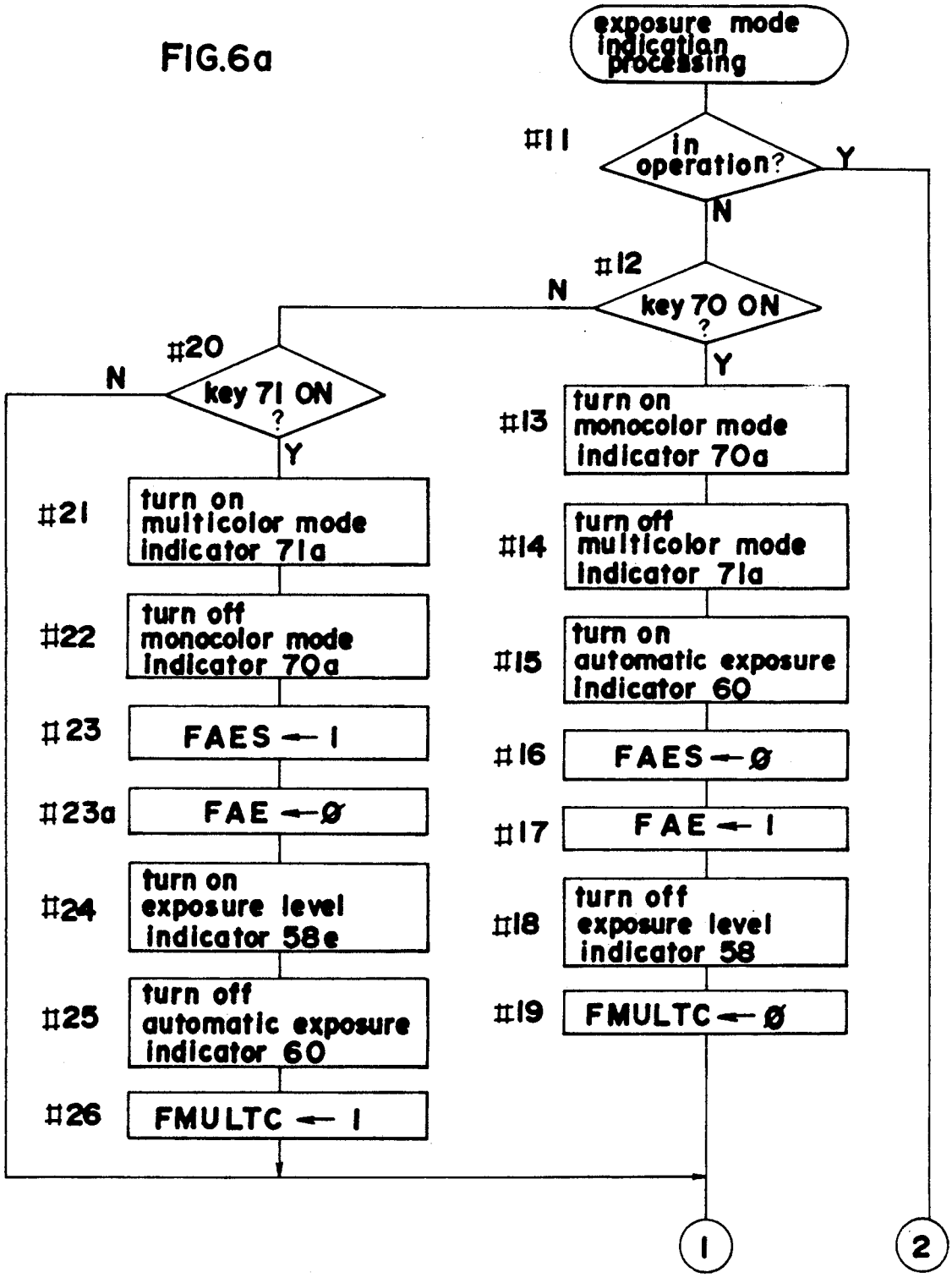
Figure 6B:
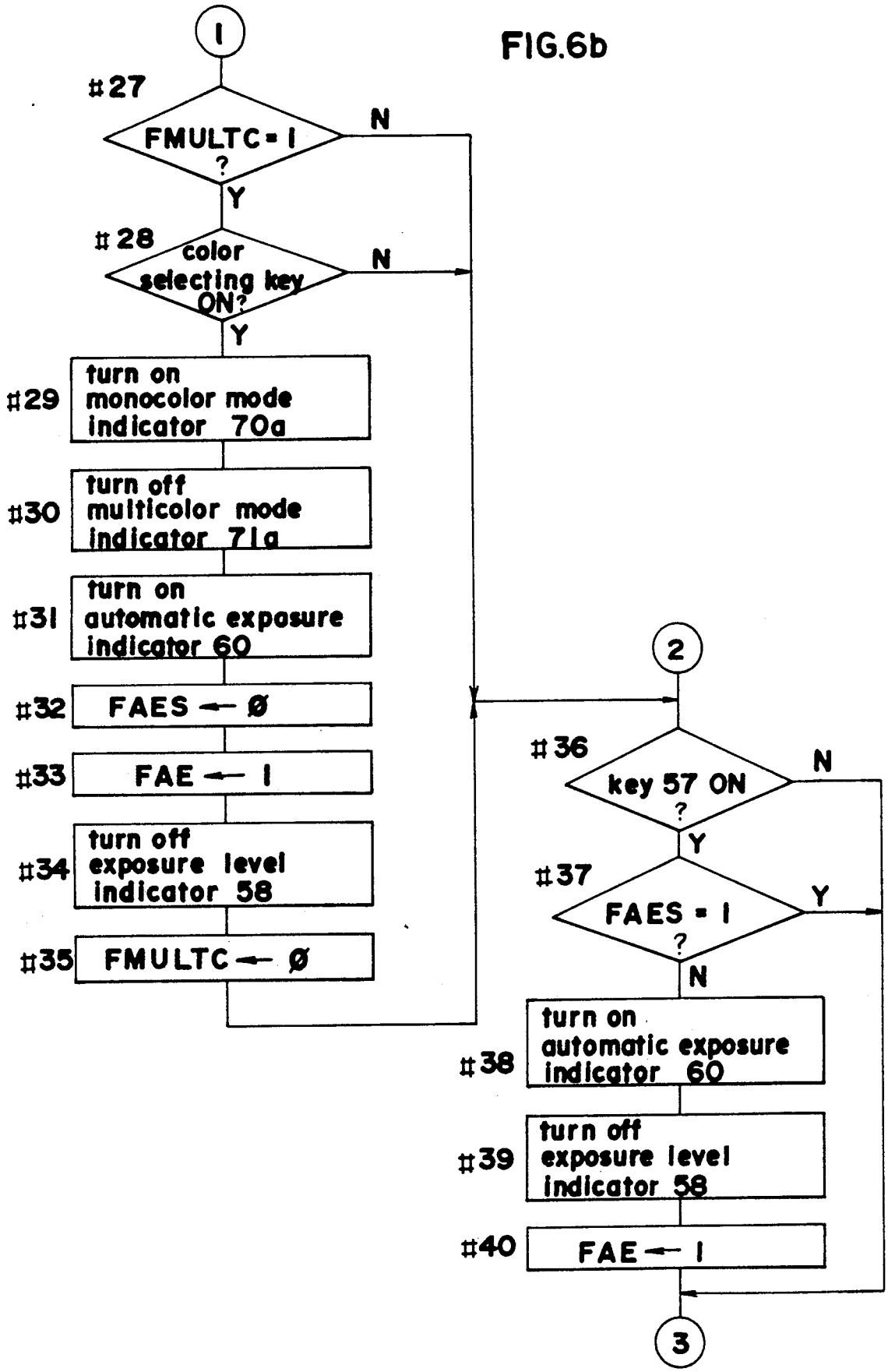
Figure 6C:
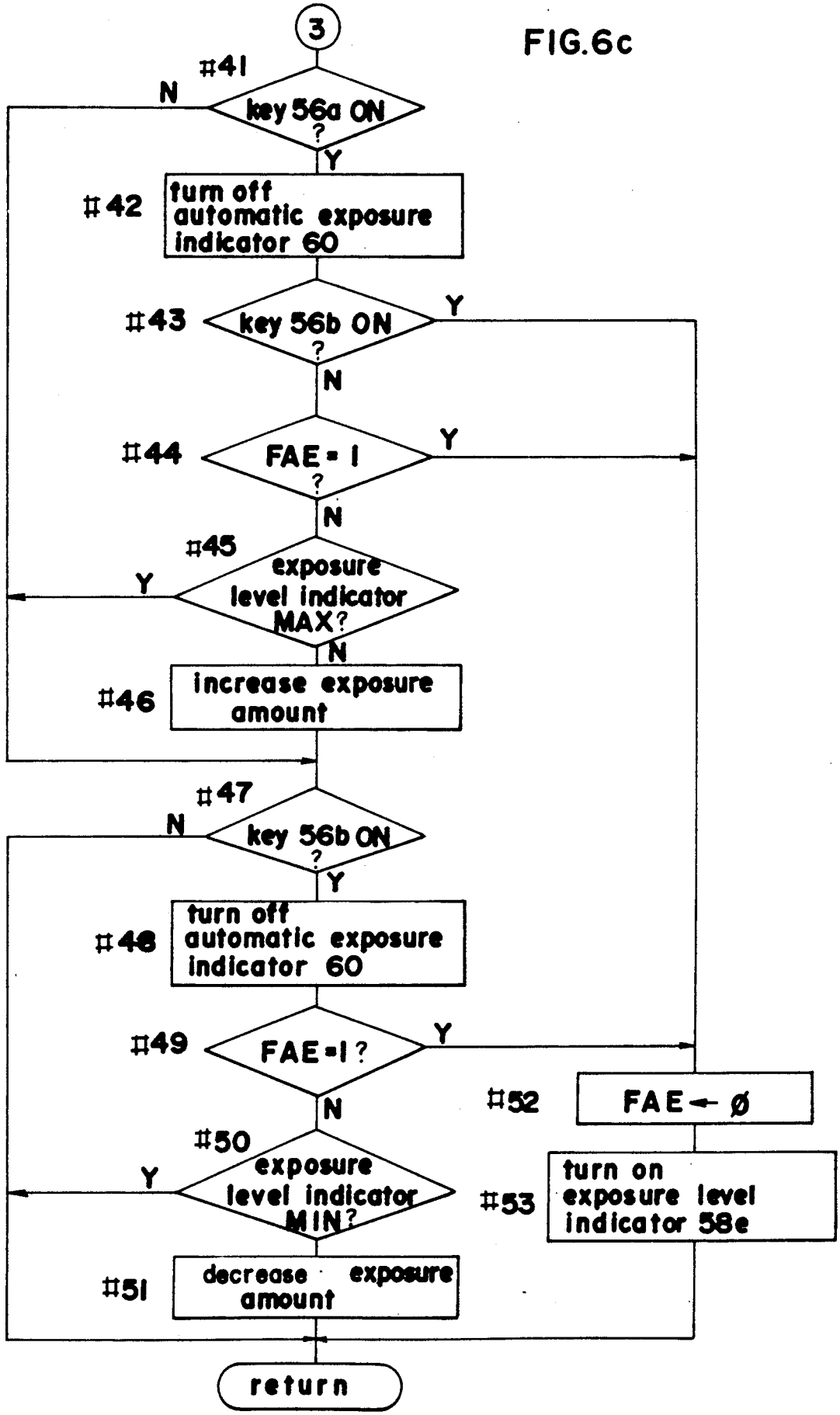

The subroutine of exposure mode indication processing will be described next with reference to FIGS. 6 (*a*), (*b*) and (*c*). First, an inquiry is made in step #11 as to whether the apparatus is in image forming operation. If it is in operation, the sequence jumps to step #36 to prohibit copy mode selection and color selection. If it is not in operation, step #12 follows to inquire whether the monocolor mode selecting key 70 has been depressed. When the answer is affirmative, indicating the selection of monocolor mode, the monocolor mode indicator LED 70*a* is turned on in step #13, the multicolor mode indicator LED 71*a* is turned off in step #14, the automatic exposure mode indicator LED 60 is turned on in step #15, an automatic exposure mode prohibit flag FAES is changed to 0 in step #16, and an automatic exposure flag FAE is set to 1 in step #17.

The flag FAES is set to 1 when the automatic exposure mode is to be prohibited. The flag FAE is set to 1 in the automatic exposure mode and is used for lighting up the exposure level indicator 58 at the middle level upon a change from the automatic exposure mode to the manual exposure mode.

The exposure level indicator 58 is thereafter turned off in step #18, followed by step #19 to reset a flag FMULTC to 0 and by step #27. This flag is set to 1 in the multicolor mode.

When the answer to the inquiry of step #12 is negative, the sequence proceeds to step #20 to inquire whether the multicolor mode selecting key 71 has been depressed. If the answer is negative, step #27 follows. When the answer to the inquiry of step #20 is affirmative, indicating that the multicolor mode has been selected, the multicolor mode indicator LED 71*a* is turned on in step #21, the monocolor mode indicator LED 70*a* is turned off in step #22, the flag FAES is set to 1 in step #23 for prohibiting the selection of the automatic exposure mode, and the flag FAE is reset to 0 in step #23*a*. Next, the exposure level indicator 58 is turned on at LED 58*e* in step #24, the automatic exposure mode indicator LED 60 is turned off in step #25, the flag FMULTC is then set to 1 in step #26, and step #27 follows.

An inquiry is made in step #27 as to whether the flag FMULTC is 1. If the answer is negative, the sequence jumps steps #28 to #35 of changing the exposure mode in accordance with a color selecting key input and proceeds to step #36. When the answer is affirmative, step #28 follows to inquire whether one of the color selecting keys 64 to 69 has been depressed. If the answer is negative, the sequence jumps to step #36. If the answer is in the affirmative, the monocolor mode indicator LED 70*a* is turned on first in step #29, the multicolor mode indicator LED 71*a* is turned off in the next step #30, the automatic exposure mode indicator LED 60 is turned on in step #31, the flag FAES is reset to 0 in the next step #32, the flag FAE is set to 1 in step #33, the exposure level indicator 58 is turned off subsequently in step #34, and the flag FMULTC is reset to 0 in step #35, followed by step #36.

Through these steps, the copy mode can be changed to the monocolor mode, and the exposure mode to the automatic exposure mode merely by manipulating the color selecting key.

In step #36, an inquiry is made as to whether the automatic exposure mode setting key 57 has been depressed. If the answer is negative, step #41 follows, whereas if otherwise, the sequence proceeds to step #37 to inquire whether the automatic exposure mode selection prohibit flag is 1. When it is 1 (indicating prohibition), the sequence jumps to step #41. If the answer to step #37 is negative, i.e., if the automatic exposure mode has been selected, with the selection thereof not prohibited, the automatic exposure mode indicator LED 60 is turned on in step #38, the exposure level indicator 58 is turned off in step #39, the automatic exposure mode flag FAE is set to 1 in step #40, and the sequence proceeds to step #41.

An inquiry is made in step #41 as to whether the exposure level up key 56*a* is on. When the answer is negative, the sequence jumps to step #47. If the answer is affirmative, this indicates that the manual exposure mode has been selected in which the exposure level is set manually, so that the automatic exposure mode indicator LED 60 is turned off in step #42, followed by step #43 to inquire whether the exposure level down key 56*b* is on. When the answer is affirmative, this indicates that both the exposure level up and down keys 56*a*, 56*b* are on. In this case, the sequence jumps to step #52 to set the manual exposure level at the middle. When the answer to step #43 is negative, the sequence proceeds to step #44, in which an inquiry is made as to whether the automatic exposure mode flag FAE is 1. When the answer is affirmative, this indicates that the automatic exposure mode has just been changed to the manual exposure mode, so that the sequence jumps to step #52 to set the manual exposure level to the middle.

When the answer to the inquiry of step #44 is negative, step #45 follows to inquire whether the level on the indicator 58 is the highest (MAX). If the answer is affirmative, no higher level is available, so that the sequence jumps to step #47. If otherwise, step #46 follows to advance the exposure level indicator 58. The sequence then proceeds to step #47.

An inquiry is made in step #47 as to whether the exposure level down key 56*b* is on. When the answer is negative, the sequence returns. When the answer is in the affirmative, step #48 follows to turn off the automatic exposure mode indicator LED 60, and an inquiry is made in the next step #49 as to whether the automatic exposure mode flag FAE is 1. If the flag is 1, step #52 follows for further processing to set the manual exposure level indicator at the middle level. When the answer to the inquiry of step #49 is negative, an inquiry is made in step #50 as to whether the exposure level indicator 58 shows the lowest level (MIN). If the answer is affirmative, no lower level is available, so that the sequence directly returns. When the answer is negative, the level on the indicator 58 is lowered in step #51, whereupon the sequence returns.

In step #52, the automatic exposure mode flag FAE is reset to 0, followed by step #53 to shift the level on the manual exposure level indicator 58 to the middle LED 58*e*.

The embodiment described is so adapted that when the multicolor mode is selected, the selection of the automatic exposure mode is prohibited, whereas the automatic exposure mode may alternatively be made selectable as another embodiment. This can be accomplished by eliminating steps #16, #23, #32 and #37 from the flow charts of FIGS. (*a*) and (*b*)

The image density, which is controlled by varying the amount of exposure to be given by the light source 22 with the present embodiment, may alternatively be controlled by adjusting the developing bias.

While the present embodiment is an example of multicolor image forming apparatus, various multicolor mode image forming apparatus are known which include digital color copying machines wherein the original image is read by a color CCD sensor, and the resulting image data is converted to electric signals to form a color image based on the signals. The present invention is applicable also to such apparatus for forming multicolor images by a process different from that of the present embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus which comprises:
   - image forming means for forming images in one of first and second modes;
   - manual adjusting means for manually adjusting the density of the images formed by said image forming means;
   - automatic adjusting means for automatically adjusting the density of the images formed by said image forming means;
   - mode selecting means for selecting one mode of said first and second modes; and
   - control means for activating said manual adjusting means in response to the first mode selection and activating said automatic adjusting means in response to the second mode selection.

2. An image forming apparatus as claimed in claim 1, which further comprises manual selecting means for manually selecting one of said manual adjusting means and said automatic adjusting means.

3. An image forming apparatus as claimed in claim 2, wherein the images are reproduced in a plurality of colors in said first mode, and the images are reproduced in a single color in said second mode.

4. An image forming apparatus as claimed in claim 3, which further comprises prohibiting means for prohibiting said automatic adjusting means from being selected by the manual selecting means when the first mode is selected.

5. An image forming apparatus which comprises:
   - image forming means for reproducing images of originals in one of a first reproduction mode wherein images of originals are reproduced in a single color and a second reproduction mode wherein images of originals are reproduced in a plurality of colors, said image forming means reproducing images with variable reproducing density;

manual operation means which is manually operated;

manual adjusting means for adjusting the image density reproduced by said image forming means in response to said manual operation means in a manual adjusting mode;

automatic adjusting means for automatically adjusting the image density reproduced by the image forming means in response to said detecting means in an automatic adjusting mode;

reproduction mode selecting means for selecting one mode from the first and second reproduction modes; and control means for selecting said manual adjusting mode in response to the second reproduction mode.

6. An image forming apparatus as claimed in claim 5, wherein said control means selects the automatic adjusting means in response to the selection of the first reproduction mode.

7. An image forming apparatus as claimed in claim 5, further comprising color selecting means for selecting the color reproduced in the first reproduction mode and an automatic selecting means for automatically selecting the first reproduction mode in response to the selection of said color selecting means, wherein said control means selects the automatic adjusting mode in response to the first reproduction mode.

8. An image forming apparatus as claimed in claim 7, wherein said automatic selecting means automatically selects the first reproduction mode in response to the selection of the color selecting means.

9. An image forming apparatus as claimed in claim 5, further comprising adjusting mode selecting means for manually selecting either of the manual adjusting mode and the automatic adjusting mode, wherein said control means prohibits the automatic adjusting mode from being selected by said adjusting mode selecting means in the second reproduction mode.

10. An image forming apparatus which comprises:

original exposure means for exposing originals with variable exposure amount;

image forming means for reproducing images of originals exposed by said original exposure means in one of a first reproduction mode wherein images of originals are reproduced in a single color and a second reproduction mode wherein images of originals are reproduced in a plurality of colors;

manual operation means which is manually operated;

manual exposure adjusting means for adjusting the exposure amount produced by said original exposure means in response to said manual operation means in a manual exposure adjusting mode;

detecting means for detecting the image density;

automatic adjusting means for automatically adjusting the exposure amount produced by said original exposure means in response to said detecting means in an automatic exposure adjusting mode;

reproduction mode selecting means for selecting one mode from the first and second reproduction modes; and control means for selecting said manual exposure adjusting mode in response to selecting the second reproduction mode.

11. An image forming apparatus as claimed in claim 10, wherein said control means selects the automatic exposure adjusting mode in response to the selection of the first reproduction mode.

12. An image forming apparatus as claimed in claim 11, further comprising color selecting means for selecting the color reproduced in the first reproduction mode and an automatic selecting means for automatically selecting the first reproduction mode in response to the selection of said color selecting means, wherein said control means selects the automatic exposure adjusting mode in response to the first reproduction mode.

13. An image forming apparatus as claimed in claim 12, wherein said automatic selecting means automatically selects the first reproduction mode in response to the selection of the color selecting means.

14. An image forming apparatus as claimed in claim 10, further comprising exposure adjusting mode selecting means for manually selecting either of the manual exposure adjusting mode and the automatic exposure adjusting mode, wherein said control means prohibits the automatic exposure adjusting mode from being selected by said exposure adjusting mode selecting means in the second reproduction mode.

15. An image forming apparatus which comprises:

image forming means for reproducing images of originals in one of a first reproduction mode wherein images of originals are reproduced in a single color and a second reproduction mode wherein images of originals are reproduced in a plurality of colors, said image forming means reproducing images with variable reproducing density;

reproduction mode selecting means for selecting one reproduction mode from said first and second reproduction modes;

reproduction color selecting means for selecting the color reproduced in the first reproduction mode;

manual operation means which is manually operated;

manual adjusting means for adjusting the image density reproduced by said image forming means in response to said manual operation means in a manual adjusting mode;

detecting means for detecting the density of originals;

automatic adjusting means for automatically adjusting the image density reproduced by the image forming means in response to said detecting means in an automatic adjusting mode;

adjusting mode selecting means for manually selecting one mode from said manual and automatic adjusting modes; and control means for selecting the first reproduction mode and automatic adjusting mode with no relation to said reproduction mode selecting means and adjusting mode selecting means in response to the operation of said reproduction color selecting means.

16. An image forming apparatus as claimed in claim 15, wherein said control means selects the manual adjusting mode in response to the selection of the second reproduction mode.

17. An image forming apparatus as claimed in claim 15, wherein said control means further prohibits the automatic adjusting mode from being selected by the adjusting mode selecting means in the second reproduction mode.

18. In a copying apparatus which reproduces images of originals in either of a single color and a plurality of colors, and is capable of adjusting the reproduction density of originals manually or automatically, the method for controlling the copying apparatus comprising the steps of:

selecting one mode from a first reproduction mode wherein images of originals are reproduced in a single color and a second reproduction mode wherein images of originals are reproduced in a plurality of colors;

selecting an automatic adjusting mode wherein the reproduction density is automatically adjusted in response to the selection of said first reproduction mode; and a manual adjusting mode wherein the reproduction density is manually adjusted in response to the selection of said second reproduction mode.

19. The method of claim 18, further comprising the steps of:

selecting the color reproduced in the first reproduction mode; and automatically selecting the first reproduction mode and the automatic adjusting mode in response to the selection of a color selecting means.

20. In a copying apparatus which reproduces exposed images of originals in either of a single color and a plurality of colors, and is capable of adjusting the reproduction density of originals manually or automatically, the method for controlling the copying apparatus comprising the steps of:

selecting one mode from a first reproduction mode wherein images of originals are reproduced in a single color and a second reproduction mode wherein images of originals are reproduced in a plurality of colors;

selecting an automatic adjusting mode wherein the exposure amount is automatically adjusted corresponding to the image density in response to the selection of said first reproduction mode; and selecting a manual adjusting mode wherein the exposure amount is manually adjusted in response to the selection of said second reproduction mode.

21. The method of claim 19, further comprising the steps of:

selecting the color reproduced in the first reproduction mode; and automatically selecting the first reproduction mode and the automatic adjusting mode in response to the selection of a color selecting means.

* * * * *

UNITED STATES PATENT AND TRADEMARK OFFICE

CERTIFICATE OF CORRECTION

PATENT NO. : 5,023,662

DATED : June 11, 1991

INVENTOR(S) : Keiji Kusumoto, et al.

It is certified that error appears in the above-identified patent and that said Letters Patent is hereby corrected as shown below:

In col. 9, between lines 7 and 8 (in claim 5, between lines 13 and 14 thereof), insert the following paragraph:

--detecting means for detecting the density of originals;--

In col. 11, line 12 (claim 18, line 16 thereof), before "a manual", insert --selecting--.

In the Abstract, in line 8 thereof, change "reproduction" to --reproduced--.

Signed and Sealed this

Twenty-seventh Day of October, 1992

*Attest:*

DOUGLAS B. COMER

*Attesting Officer*

*Acting Commissioner of Patents and Trademarks*